US012742397B2

(12) United States Patent
Šimka et al.

(10) Patent No.: US 12,742,397 B2
(45) Date of Patent: Sep. 22, 2026

(54) TURBINE ASSEMBLY OF AN AXIAL-FLOW TURBINE AND AXIAL-FLOW TURBINE

(71) Applicant: DOOSAN ŠKODA POWER A.S., Plzeň (CZ)

(72) Inventors: Zdeněk Šimka, Hlohová (CZ); Jan Pinkas, Velké Hydice (CZ); Miloslav Bílý, Plzeň (CZ)

(73) Assignee: DOOSAN SKODA POWER A.S., Jiní Predmestí (CZ)

( * ) Notice: Subject to any disclaimer, the term of this patent is extended or adjusted under 35 U.S.C. 154(b) by 0 days.

(21) Appl. No.: 19/106,257

(22) PCT Filed: Aug. 24, 2023

(86) PCT No.: PCT/CZ2023/050055
§ 371 (c)(1),
(2) Date: Feb. 25, 2025

(87) PCT Pub. No.: WO2024/041680
PCT Pub. Date: Feb. 29, 2024

(65) Prior Publication Data

US 2026/0002449 A1 Jan. 1, 2026

(51) Int. Cl.
*F01D 11/02* (2006.01)
*F01D 5/02* (2006.01)
*F01D 5/14* (2006.01)

(52) U.S. Cl.
CPC ..... *F01D 11/02* (2013.01); *F01D 5/021* (2013.01); *F01D 5/141* (2013.01)

(58) Field of Classification Search
CPC ..... F01D 11/001; F01D 11/02; F01D 11/08
See application file for complete search history.

(56) References Cited

U.S. PATENT DOCUMENTS 3,291,447 A 12/1966 Brandon
3,746,462 A * 7/1973 Fukuda ..... F01D 11/10 415/115

(Continued)

FOREIGN PATENT DOCUMENTS

DE 2140720 A1 2/1973
DE 4331779 A1 3/1995

(Continued)

OTHER PUBLICATIONS

International Search report for PCT/CZ20023/050055, prepared by the European Patent Office, mailing date Jan. 10, 2024, 5 pages.

(Continued)

*Primary Examiner* — Nathaniel E Wiehe
*Assistant Examiner* — Jackson N Gillenwaters
(74) *Attorney, Agent, or Firm* — Brooks Kushman P.C.

(57) ABSTRACT

Turbine assembly according to the present invention has passages formed in the fixing part of the second wheel of the assembly between at least some adjacent blades for draining the working medium that has leaked through the non-contact seal of the first wheel of the assembly from the axial gap further in the direction of expansion of the working medium back into the primary flow path. The passage inlet according to the present invention is located on the side of the fixing part facing the labyrinth seal of the preceding wheel radially between a virtual circle with the centre in the turbine assembly axis and a radius of $R8_{in}$−0.6*A and a virtual circle with the centre in the turbine assembly axis and a radius of $R8_{out}$+0.6*A, where $R8_{in}$ is the inner and R8out is the outer radius of the radial gap of the last fin of the non-contact seal, and A is the axial distance between the last fin of the non-contact seal and the side of the fixing part of the next wheel facing the non-contact seal of the preceding wheel in operation. The passage outlet according to the present inven- (Continued)

tion exits into the primary flow passage between the blades at an axial distance of at least ⅕ of the total axial width of the blade cascade from the leading edge of the blades.

21 Claims, 10 Drawing Sheets

(56) References Cited

U.S. PATENT DOCUMENTS

| | | | | |
|---|---|---|---|---|
| 3,817,654 | A * | 6/1974 | Sohma | F01D 5/06 415/103 |
| 5,328,326 | A | 7/1994 | Gros et al. | |
| 8,147,180 | B2 | 4/2012 | Tani et al. | |
| 8,147,182 | B2 | 4/2012 | Aynsley et al. | |
| 8,753,070 | B2 * | 6/2014 | Elorza Gomez | F04D 29/542 415/168.2 |
| 10,018,046 | B2 | 7/2018 | Nomura et al. | |
| 10,041,368 | B2 | 8/2018 | Homer | |
| 11,092,028 | B2 * | 8/2021 | Haller | F01D 11/08 |
| 2004/0136828 | A1 | 7/2004 | Montgomery | |
| 2011/0274536 | A1 * | 11/2011 | Inomata | F01D 5/085 415/178 |

FOREIGN PATENT DOCUMENTS

| | | | |
|---|---|---|---|
| EP | 0457240 | A1 | 11/1991 |
| EP | 0894945 | A2 | 2/1999 |
| GB | 1013835 | A | 12/1965 |

OTHER PUBLICATIONS

Written Opinion of the International Searching Authority for PCT/CZ20023/050055, prepared by the European Patent Office, mailing date Jan. 10, 2024, 11 pages.

* cited by examiner

(State of the art)

STATOR

ROTOR

STATOR

ROTOR

STATOR

ROTOR

STATOR

ROTOR

STATOR

ROTOR

TURBINE ASSEMBLY OF AN AXIAL-FLOW TURBINE AND AXIAL-FLOW TURBINE

CROSS-REFERENCE TO RELATED APPLICATION

This application is the U.S. national phase of PCT Application No. PCT/CZ2023/050055 filed on Aug. 24, 2023, which claims priority to CZ Patent Application No. PV 2022-355 filed on Aug. 25, 2022, the disclosures of which are incorporated in their entirety by reference herein.

TECHNICAL FIELD

The present invention concerns all types of axial-flow turbines in general, both steam turbines (where the working medium is steam) and gas turbines in general (where the medium may also be flue gas, gas, air, etc.), in all variants thereof.

The flow path of the axial-flow turbine consists of individual axial stages. The stages are formed alternately by consecutive wheels of stator and rotor.

The stator wheel consists mainly of a blade cascade which consists of individual airfoils placed side by side around the circumference of the stator wheel. On the outer circumference, the airfoils are fixed to the stator with the fixing part(s). The fixing part can either be integral (the ring in the assembled stator wheels) or each blade can have its own partial fixing part (in milled blades). On the inner diameter, the stator blade cascade is sealed against the rotor using a shroud or a disc with a non-contact seal. The stator wheel shroud can be either integral for up to half of the cascade or (for milled blades) it can be integral for each blade separately.

The rotor wheel consists mainly of a blade cascade which consists of individual airfoils placed side by side around the circumference of the rotor wheel. On the inner circumference, the airfoils are firmly fixed by fixing parts to the rotor or rotor disc. On the outer diameter, the rotor blade cascade is sealed against the rotor using rotor shroud with a non-contact seal. The rotor wheel shroud can be either common for several blades or integral for each blade separately in the case of milled blades.

The stator blades are designed to accelerate the flow of the working medium and direct it in the circumferential direction, the rotor blades are designed to capture the spinning flow and transfer the forces caused by flowing around to the rotor. The blade passages of the stator and rotor blade cascade together with the axial gaps between the blade cascades form the primary flow path.

The mounting arrangement of the rotor blades affects the stage design. The stage can be either of the drum type, where the blades forming the rotor wheel are attached directly to the rotor body, or it can be of the wheel or disc type, where the disc is formed on the rotor and then the blades attached to it. Drum-type stages are usually used for higher reaction stages, whereas wheel-type stages are usually used for low reaction stages.

The rotor must be allowed to rotate relatively with respect to the stator and possibly also have some axial movement, e.g. due to different deformations caused by thermal expansion. Due to the requirements for long durability, non-contact seals are usually used for this purpose which must have a certain gap or clearance. The gap/clearance is to be as minimal as possible, but cannot be closed completely. Therefore, manufacturers try to reduce the flow coefficient of the non-contact seal as much as possible. Typical representatives of such non-contact seals are labyrinths of various types-staggered labyrinth, look through labyrinth, fin-fin type seals. Non-contact seals also include honeycomb seals which work on a similar principle and can, therefore, be also considered as labyrinth seals, only the labyrinth fins have a more complicated shape. The non-contact seal together with the axial gaps in front and behind it, which connects them to the primary flow path, form the secondary flow path.

Thus, a small amount of working medium, called secondary flow, flows through the non-contact seal (as opposed to the primary flow passing through the blades). Secondary flows are a source of losses. The losses are caused by the leak itself—the medium bypassing the stator blades through seal does not accelerate to the required velocity, the medium bypassing the rotor blades cannot exert force on them and thus drive the rotor. Further losses occur at the point where the secondary flow of media leaked through the seal re-enters into the primary flow. This is because there is a mixing of flows that have different direction and velocity. In addition, there is an unfavourable interaction of the two flows in the sensitive region upstream of the following blade cascade. This is where secondary vortexes are formed that can be reinforced by this interaction.

All these losses depend on the amount of medium flowing through the secondary flows. Therefore, one of the ways to reduce these losses is to reduce the flow rate through non-contact seals. However, this reduction has its limits due to the need for reliable operation throughout the operating range of the machine.

STATE OF THE ART

In the standard design of the stage, the non-contact seal usually exits into the axial gap (the "cavity") between the shroud or disc and the blade fixing part in the direction of the main flow of the next wheel. The secondary flow exits the non-contact seal at a relatively high velocity, overcomes the axial gap by inertia and strikes the face of the fixing part of the next wheel, against which it bends and the axial component of the velocity turns into a radial one, the circumferential component of the flow being only slightly reduced by friction. Thus, the secondary flow enters the primary flow with a high radial component and, in the system of coordinates associated with the blade cascade of the next wheel, also with a high circumferential component. Both of these components are significantly different from the primary velocity components and the interaction of the flows thus results in high losses.

Various solutions are applied to reduce the losses arising from the interaction between the secondary flow returning from the seal to the primary flow. For example, U.S. Pat. No. 9,476,315B2 describes a solution that counteracts the circumferential component of the secondary flow velocity. This reduces the difference between the circumferential component of the primary flow which is very small, and the circumferential component of the secondary flow velocity. This will reduce the losses caused by mixing of the two flows and also the loss due to increased secondary losses in the blade cascade further downstream. The disadvantage is that some of the kinetic energy of the secondary flows, which could be utilised, is lost.

Another way to reduce these losses are passages in the stator or rotor fixing parts which allow the secondary flow to bypass the next blade cascade and again fill the seal of the next downstream blade cascade (e.g. DE 4331779 A1, U.S. Pat. Nos. 8,147,180 B2, 5,328,326 or 10,041,368 B2). The secondary flow does virtually not return to the primary flow, does not affect it and does not increase the losses in the blade cascade. The disadvantage is that the kinetic energy contained in the secondary flow is not used at all in this case.

Thus, none of the solutions mentioned above address the utilisation of kinetic energy of the secondary flow. Nevertheless, the kinetic energy of the secondary flow in the flow relative to the next blade cascade is bigger than the kinetic energy of the primary flow. The use of kinetic energy coming from the packing is dealt with e.g. in patent U.S. Pat. No. 5,328,326 (see FIG. 5 of this document) where the fixing part of the rotor blades is bevelled, the medium flowing from the stator wheel seal can thus flow between the rotor blades and its kinetic energy is at least partially utilised. However, a big disadvantage is that in the relative system of coordinates, the secondary flow has a big circumferential component in the direction opposite to the rotation of the rotor blades and the flow hits the suction (back) side of the rotor blades, which on the one hand causes their braking, and on the other hand it is the same direction in which the secondary vortex rotates. The secondary flow thus intensifies the secondary vortex and increases the secondary losses.

This problem is addressed in document DE2140720A1, where a similarly shaped fixing part at the hub of the rotor blades is described as the previous one, but with the addition of a protrusion from the stator wheel disc that overlaps this shape. The protrusion guides the secondary flow in the axial direction. Grooves are then formed on its inner side flowed around by the secondary flow, guiding the secondary flow in the correct circumferential direction. However, the efficiency of this guiding is very low and this solution is associated with large losses of kinetic energy of the secondary flow. In addition, this disc protrusion extends the axial length of the stage, which results in fewer stages for the given bearing distance and poorer turbine efficiency.

SUMMARY OF THE INVENTION

The above mentioned shortcomings of the current state-of-the-art are eliminated by the turbine assembly according to the present invention as defined in claims 1 and 9, respectively, and the axial-flow turbine according to claim 20.

These devices reduce the losses in the axial-flow turbine that occur when secondary flows that pass through leaks return to the primary flow.

In the case of a turbine assembly consisting of a stator wheel followed by the rotor wheel in the direction of the working medium flow, such turbine assembly is referred to as the turbine stage. For the purposes of describing the present invention, the general term of turbine assembly will include both the stator wheel-rotor wheel pair and the rotor wheel-stator wheel pair that follows in the direction of the main working medium flow.

In the turbine assembly according to the present invention, passages are formed in the fixing part (in the working medium flow direction) of the second wheel of the assembly (i.e. the rotor or stator wheel) at least between some adjacent blades for draining the working medium that has leaked through the labyrinth seal (in the working medium flow direction) of the first wheel of the assembly (i.e. the stator or rotor wheel) and introducing it back to the primary flow path.

The passage inlet according to the present invention is located on the side of the fixing part facing the labyrinth seal of the preceding wheel radially between a virtual circle with the centre in the turbine assembly axis and a radius of $R8_{in}-0.6*A$ and a virtual circle with the centre in the turbine assembly axis and a radius of $R8_{out}+0.6*A$, where $R8_{in}$ is the inner and $R8_{out}$ is the outer radius of the radial gap (commonly referred to as radial clearance) of the last fin of the labyrinth seal, and A is the axial distance between the last fin of the labyrinth seal and the side of the fixing part of next wheel facing the labyrinth seal of the preceding wheel in operation (the axial distance between the radial clearance of the last fin and the blade fixing part may differ with some types of packing in operation and in the turbine's non-operating state).

The passage outlet according to the present invention exits into the primary flow passage between the blades at an axial distance of at least ⅓ of the total axial width of the blade cascade from the leading edge of the blades.

The solution according to the present invention reduces losses through mixing and interaction of the secondary flows with the primary one and increases the overall efficiency of the turbine assembly and thus the turbine as a whole. This solution is based on creating passages that appropriately drain the secondary flow from the non-contact seal into the blade cascade which is downstream the given non-contact seal. The passages guide the secondary flow so that it does not disturb the primary flow and its kinetic energy is used to reduce losses and increase the work done by the stage. The passages are located in the fixing parts of the wheels downstream the given packing, thus not increasing the axial length of the stage. There is enough space for the secondary flow to be guided correctly and only after such guiding, the secondary flow is introduced into the primary blade passage. Passages can be formed in the fixing parts of rotor blades, as well as in the fixing parts of stator blades for both drum and wheel (disc) type stages.

Advantageous embodiments are subject to dependent claims. Preferably in a turbine assembly according to the present invention:

- passages are formed between all the blades of the wheel,
- the passage inlet is located on the side of the fixing part facing the labyrinth seal of the preceding wheel radially at the level of the gap at the last fin of the labyrinth seal, i.e. at the same radial distance from the axis of the turbine assembly as the radial gap; thus the working medium can flow from the radial gap at the last fin of the labyrinth seal directly into the passage inlet,
- the passage inlet extends substantially across the entire width of the blade passage in the circumferential direction between adjacent blades, i.e. substantially across the entire spacing between the blades,
- the radial height of the passage at the inlet exceeds or equals the radial gap size of the last fin of the labyrinth seal ($R8_{out}-R8_{in}$), preferably lying between ($R8_{out}-R8_{in}$) and $4*(R8_{out}-R8_{in})$,
- the passage outlet exits into the primary flow passage between the blades at an angle (measured in the meridian plane from the end wall surface of the blade passage at the point of passage outlet) of less than 45°, preferably having an angle of less than 26°,
- at least one additional labyrinth seal fin is formed on the first wheel shroud of the assembly, and a cylindrical surface is formed on the fixing part of the second wheel (or directly on the rotor or stator) before the passage inlet, forming with this additional fin the last radial gap of the labyrinth seal and connecting this last radial gap of the labyrinth seal with the passage inlet. For a turbine assembly consisting of a stator wheel and a rotor wheel arranged downstream of it in the direction of the working medium flow (i.e. for the passages formed in the rotor), an additional fin may be formed directly on the stator disk and a cylindrical surface directly on the rotor wheel, in particular on the rotor disk (especially in the case of the wheel (disk) type of turbine stage).

The passage outlet cross-section has a size ranging from 20% to 120%, preferably 85%, of the gap size of the last labyrinth seal fin per blade of the second wheel of the assembly.

For the area of the $Fs_{seal}$ of the gap at the last stator labyrinth seal fin per rotor blade in the case of a conventional circular gap at the last stator labyrinth seal fin, the following shall apply $$Fs_{seal} = \frac{\pi * (R8s_{out}^2 - R8s_{in}^2)}{Nr},$$

where Nr is the total number of rotor blades in the rotor wheel.

For the area of $Fr_{seal}$ of the gap area of the last rotor labyrinth seal fin per stator blade in the case of a conventional circular gap at the last rotor labyrinth seal fin, the following shall apply $$Fr_{seal} = \frac{\pi * (R8s_{out}^2 - R8s_{in}^2)}{Ns},$$

where Ns is the total number of stator blades in the stator wheel.

In the case of a turbine assembly consisting of a rotor wheel and a stator wheel arranged in the direction of the working medium flow downstream (i.e. for passages formed in the stator), further preferably:

the passage outlet extends substantially across the entire width of the blade passage in the circumferential direction between adjacent stator wheel blades, the radial height of the passage at the outlet to the primary blade passage is 0.25 to 1.1 times its radial height at the inlet, preferably 70% of its radial height at the inlet, the passage outlet exits into the primary flow passage between the blades of the stator wheel at an axial distance of at least ½*Bs, preferably between 0.64*Bs and 0.86*Bs from the leading edge of the blades, where Bs is the total axial width of the stator blade cascade at the point of its connection to the fixing part.

All directions (radial, circumferential, axial, longitudinal, etc.) are named throughout the text in relation to the main axis of the turbine. The plane containing the main axis of the turbine is identified as "meridian" plane.

DESCRIPTION OF DRAWINGS

The invention will be explained in details using specific embodiments illustrated in the drawings shown:

FIG. 4*a*—Y-Y section in FIG. 2 showing the radial centrifugal view of the fixing parts of the stator blades with the passage shape. Embodiment with a separate deflector 9*s* for the design of assembled stator wheels with drawn airfoil profiles.

FIG. 4*b*—Y-Y section in FIG. 2 showing the radial centrifugal view of the fixing parts of the stator blades with the passage shape. Passage shape for stator wheel design with airfoils milled in one piece with fixing parts.

DESCRIPTION OF EMBODIMENTS

Embodiment 1

Figure 2:
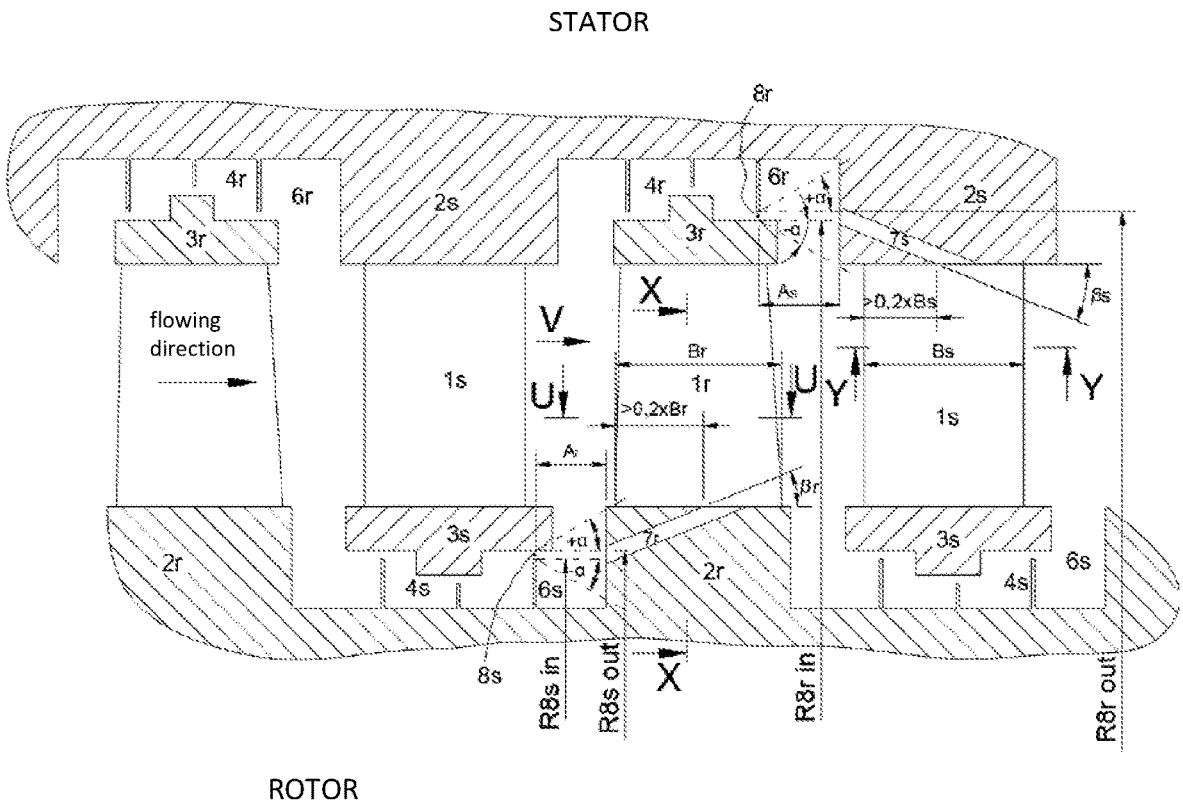
FIG. 2—longitudinal section of the flow path with axial stages of drum type with cylindrical end wall surfaces at the hub and tip and non-contact seals of the stator and rotor wheel of the staggered labyrinth type. The passages in the fixing parts of the rotor and stator blades are shown.
Figure 3:
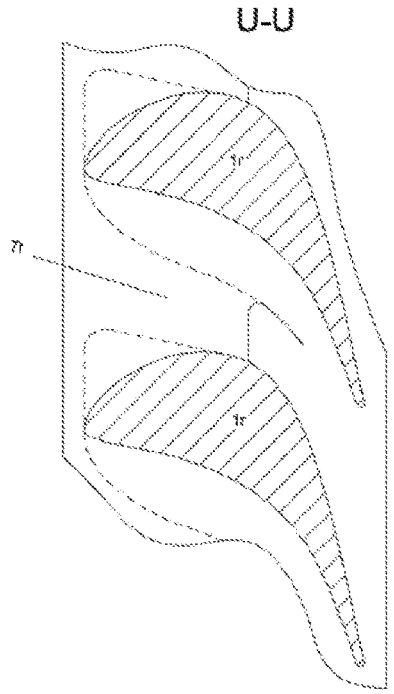
FIG. 3—U-U section in FIG. 2 showing the radial centripetal view of the rotor blade fixing part with the passage shape and outlet.

Bottom part of FIG. 2 shows a turbine assembly of an axial-flow turbine, consisting of a stator wheel and a rotor wheel arranged in the direction of the working medium flow downstream, or a turbine stage, in this case of the drum type, where the blades forming the rotor wheel are fixed directly to the rotor body. The stator wheel consists of airfoils of the blades 1*s* placed side by side around the circumference of the stator wheel to form a stator blade cascade, a fixing part 2*s* which fixes the blades 1*s* to the stator and which also seals the blade cascade on the outer circumference, the blade cascade being sealed against the rotor on the inner circumference by a shroud 3*s* with a non-contact labyrinth seal 4*s*. The rotor wheel consists of airfoils of the blades 1*r* arranged side by side around the circumference of the rotor wheel to form a rotor blade cascade, a fixing part 2*r* fixing the blades 1*r* to the rotor and that seals the blade cascade on the inner circumference, the blade cascade being sealed against the stator on the outer circumference with a shroud 3*r* with a non-contact labyrinth seal 4*r*. In this embodiment, it is the so called staggered labyrinth.

In the fixing part 2*r* of the rotor wheel, at least between some adjacent blades 1*r*, passages 7*r* are formed for draining the working medium that has leaked through the labyrinth seal 4*s* from the axial gap (the "cavity") 6*s* and introducing it back into the primary flow path. The inlet of the passage 7*r* is located on the side of the fixing part 2*r* facing the labyrinth seal 4*s* of the preceding stator wheel.

Figure 1:
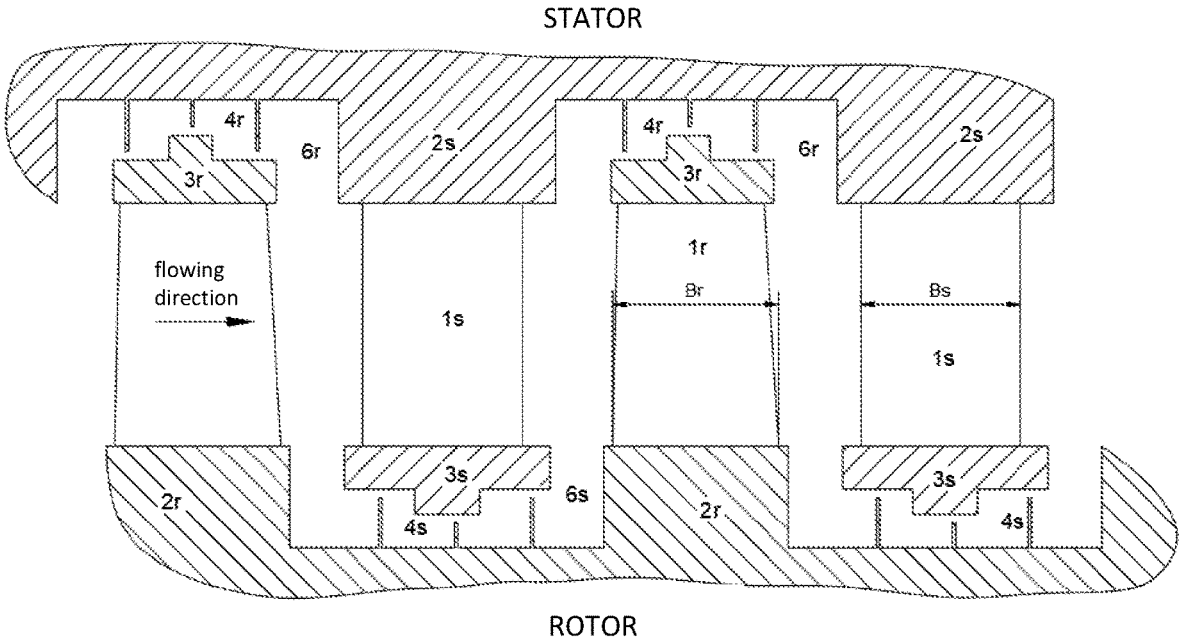
FIG. 1—longitudinal section of the flow path with axial stages of drum type with cylindrical end wall surfaces at the hub and tip and non-contact seals of the stator and rotor wheel of the staggered labyrinth type. Standard state-of-the-art design.

The secondary flow exiting the non-contact seal of the stator 4*s* enters the passage 7*r*, firstly because the passage is opposite the exit of the non-contact seal and the flow goes to it by inertia, secondly the passage exits into the rear part of the main rotor passage where the pressure is lower than at the passage inlet and the secondary flow is, therefore, sucked into the passage outlet. Thus, very little or no part of the secondary flow enters the main passage through the axial gap, as would be the case with a standard stage design according to FIG. 1. The flow disruption and the secondary vortex intensification are thus minimal.

Although it is advantageous if the passage inlet is located directly opposite the outlet of the non-contact seal, it has been found that the passage works well if its inlet is located over a relatively wide range of angles ($-\alpha$, $+\alpha$), certainly for a from 0° to approximately 30°, or even more, measured in the meridian plane.

The passage shape is such that it guides the secondary flow in the meridian plane at an acute angle $\beta_r$ into the primary flow so that the radial component is small. In the circumferential direction, the passage is shaped so that the secondary flow is drained to the suction (back) side of the blade with the lowest possible losses. Here, the secondary flow after entering the main passage, due to its higher relative kinetic energy, will accelerate the boundary layer that would otherwise form on the flowed around surface of the fixing part 2*r*, further reducing rotor blade losses.

Figure 6:
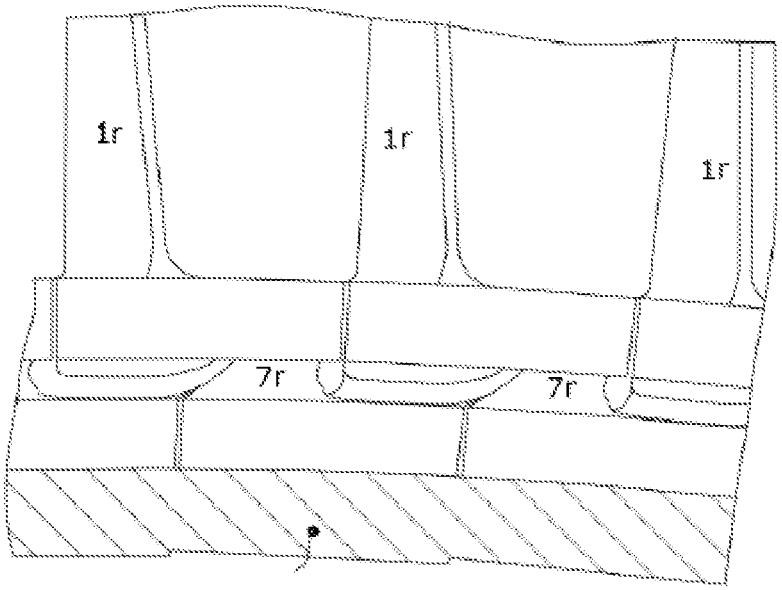
FIG. 6—detail of the frontal V view of the rotor wheel in FIG. 2 showing the passage inlets in the rotor blade fixing parts.
Figure 7:
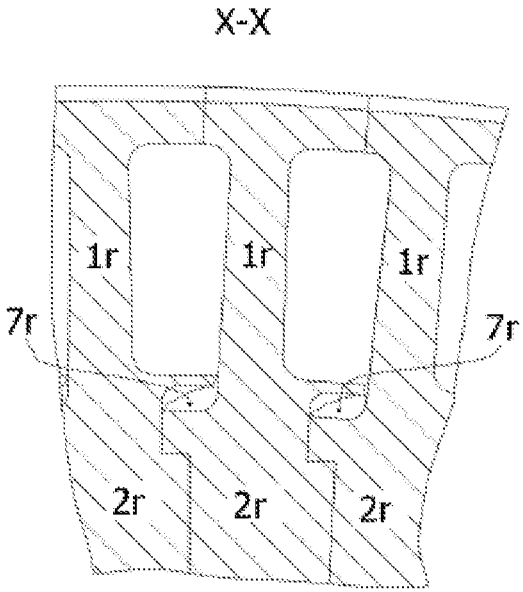
FIG. 7—frontal X-X section of the rotor wheel in FIG. 2 showing the cross-sections of the passages in the fixing parts of the rotor blades.

The passage may be formed, for example, by milling so that its walls defining it in the circumferential direction are formed on the fixing parts of adjacent blades and its wall limiting it radially on the side closer to the main passage is formed on one blade and its wall limiting it radially on the side further away from the main passage is formed on the other blade. The passage is thus formed by attaching the blades together, as shown in FIG. 6 and FIG. 7. But this is only one of the options of creating passages. Another option is, for example, drilling or fixing other component(s) to the fixing part 2*r* or airfoils to close the passage relative to the main passage.

Embodiment 2

Another possible application of the patented principle constitutes the passages formed in the fixing part 2*s* of the stator blades which are shown in the upper part of FIG. 2. Here, the use is limited to stages that have another stage immediately upstream with a non-contact seal 4*r* on the rotor shroud 3*r*. There is no benefit in using passages at the first stages of the flow paths or at the stages that are downstream the working media extraction from the flow path.

The passage design can be described as follows—in the fixing part 2*s* of the stator wheel, passages 7*s* are formed at least between some adjacent blades 1*s* for draining the working medium which has leaked through the labyrinth seal 4*r*, from the axial gap (the "cavity") 6*r* into the primary flow path. The inlet of the passage 7*s* is located on the side of the fixing part 2*s* facing the labyrinth seal 4*r* of the preceding rotor wheel.

Figure 4A:
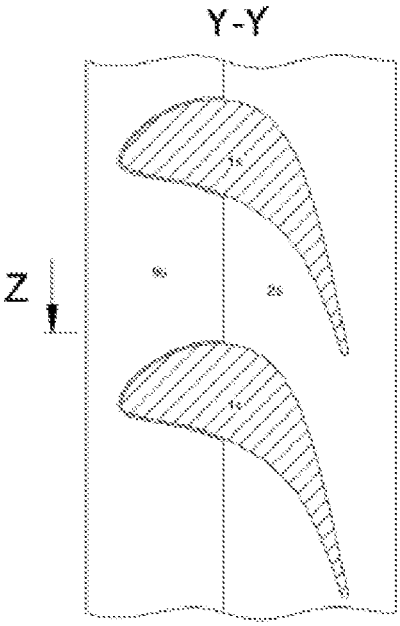
Figure 4B:
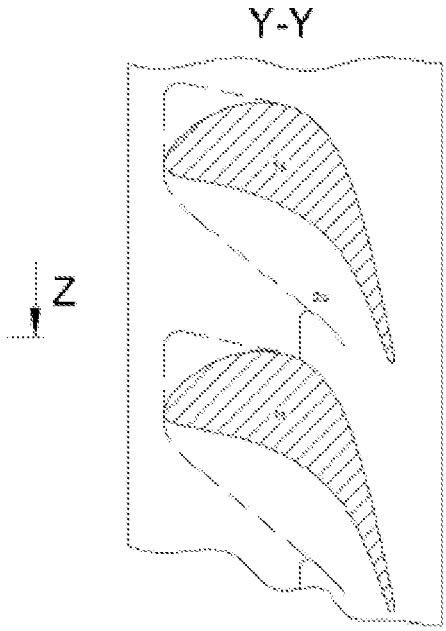

The passage can be formed by milling in a similar manner as described above for the passages in the rotor fixing parts and its function is then analogous to that described. This technology is suitable for blades produced by milling, where the airfoil and its fixing part are made of one piece. The passage can then be shaped aerodynamically in an optimal case, as shown in FIG. 4*b*. The passage should have as little resistance as possible and should have sufficient flow area at the outlet to discharge the medium.

Embodiment 3

Figure 5:
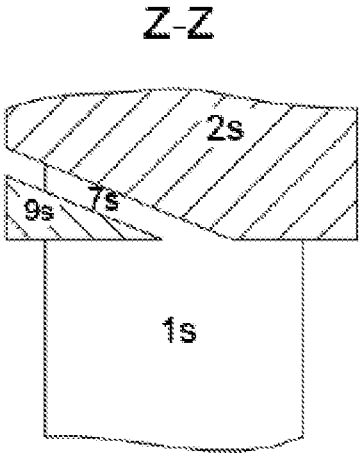
FIG. 5—Z-Z section in FIG. 4*a* showing a section of the passage formed between the separate deflector 9*s* and the fixing part 2*s* for the design of the assembled stator wheels with drawn airfoil profiles.

A different technology is suitable for airfoils of stator blades 1*s* made of drawn profiles and then assembled with a ring forming the fixing part 2*s*. The ring of the fixing part 2*s* is shaped to have the shape of the outer end wall surface of the passage, and the inner end wall surface is then formed by the deflector 9*s* which is a separate component here with cutouts for the blades 1*s* which is inserted between the blades 1*s*. The passage 7*s* then takes the form of a slot between the deflector 9*s* and the fixing part 2*s*, see FIG. 5. The airfoils of the blades 1*s* pass through the slot 7*s* and define the shape of the passage 7*s* in the circumferential direction. The passage outlet 7*s* then takes a form of a slot across the entire width of the primary blade passage, see FIG. 4*a*. The secondary flow passing through the slot separates from the profile surface as it flows around the profile, which is associated with losses, but the important thing is that it is prevented by the deflector 9*s* from flowing in the radial direction along the airfoil and amplifying the secondary vortex. Despite these losses, most of the secondary flow retains high kinetic energy and re-accelerates the boundary layer at the passage outlet, thus reducing the losses in the stator blade cascade 1*s*. Another beneficial effect is that the secondary flow of the medium that has a higher energy than the primary flow, is guided in a centripetal sidelong direction underneath the shroud of the following rotor wheel 1*r* and thus does not leak into the rotor seal 4*r*. The work done by it is greater than the work that would be done by the same flow rate of the primary flow.

Embodiment 4

Figure 8:
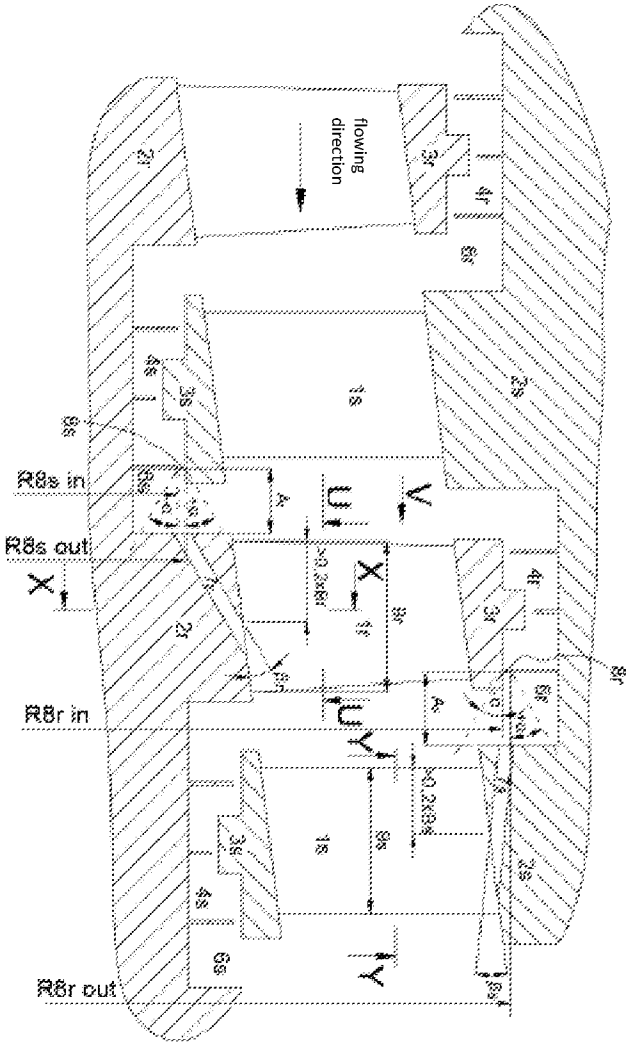
FIG. 8—longitudinal section of the flow path with axial stages of drum type with conical end wall surfaces at the hub and tip and non-contact seals of stator and rotor wheel of the staggered labyrinth type. The passages in the fixing parts of the rotor and stator blades are shown.

FIG. 8 shows a solution similar to the previous examples 1-3, but the stages shown differ in the conical surfaces on the end wall surfaces of the fixing parts 2*s* and 2*r* and on the shrouds 3*s* and 3*r*.

Embodiment 5

Figure 9:
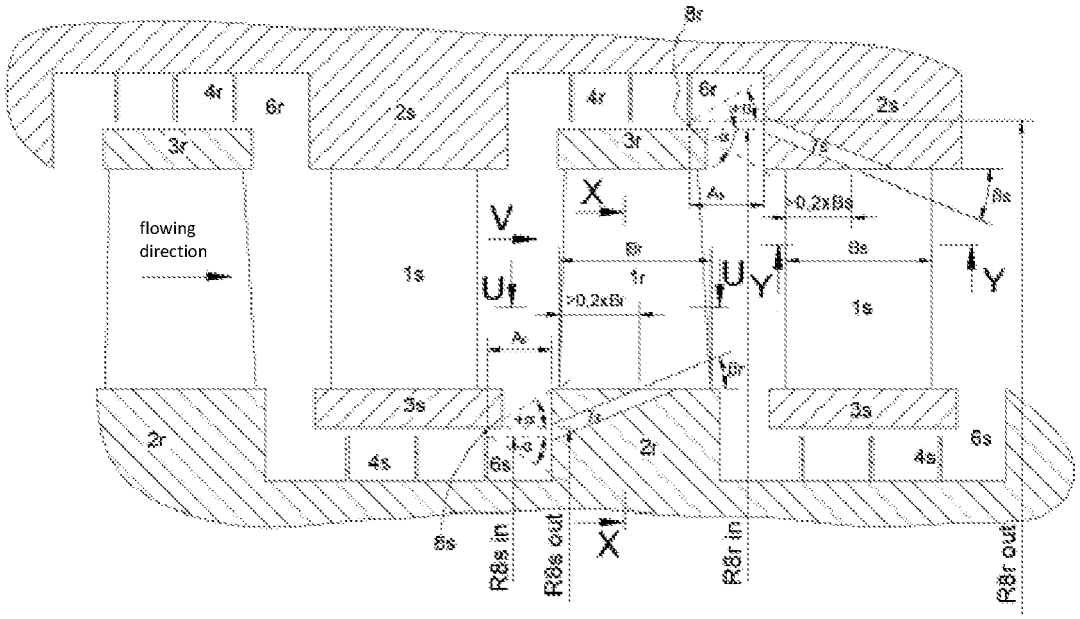
FIG. 9—longitudinal section of the flow path with axial stages of drum type with cylindrical end wall surfaces at the hub and tip and non-contact seals of stator and rotor wheel of the look through labyrinth type. The passages in the fixing parts of the rotor and stator blades are shown.

FIG. 9 shows a solution similar to the previous examples 1-3, but differs in the non-contact seals of the look through labyrinth type.

Embodiment 6

Figure 10:
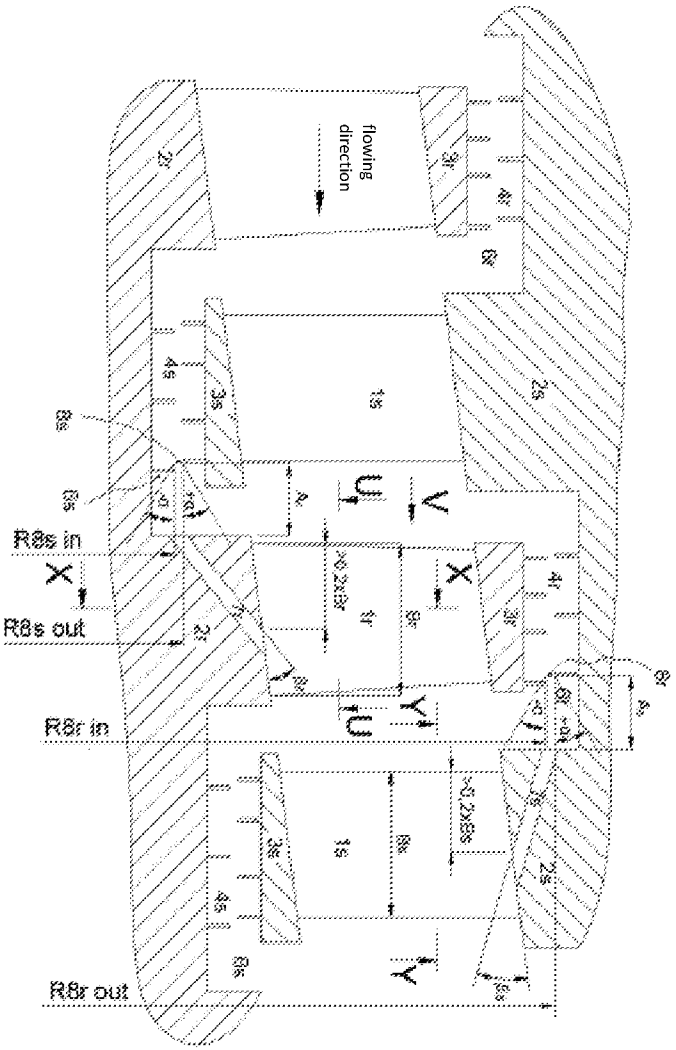
FIG. 10—longitudinal section of the flow path with drum type axial stages with conical end wall surfaces at the hub and tip and non-contact seals of the stator and rotor wheel of the fin-fin type. The passages in the fixing parts of the rotor and stator blades are shown.

FIG. 10 shows a solution similar to the previous examples 1-3, but differs in the non-contact seals of the fin-fin type.

Embodiment 7

Figure 11:
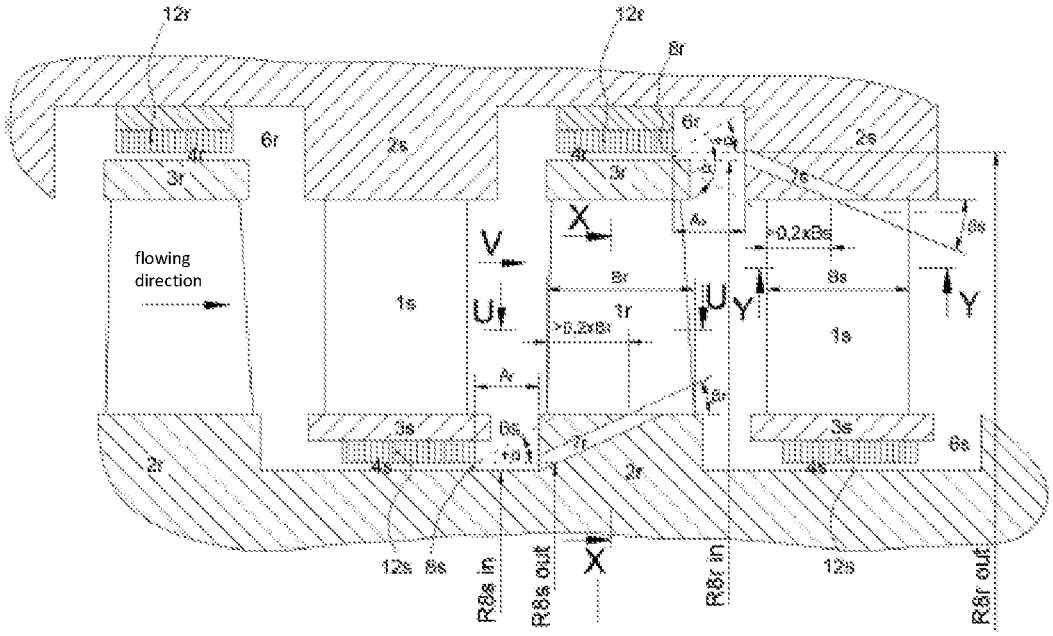
FIG. 11—longitudinal section through the flow path with axial stages of drum type with cylindrical end wall surfaces at the hub and tip and non-contact seals of stator and rotor wheel of a honeycomb type. The passages in the fixing parts of the rotor and stator blades are shown.

FIG. 11 shows a solution similar to the previous examples 1-3, but differs in non-contact seals of the honeycomb type 12*s*, 12*r*.

Embodiment 8

Figure 12:
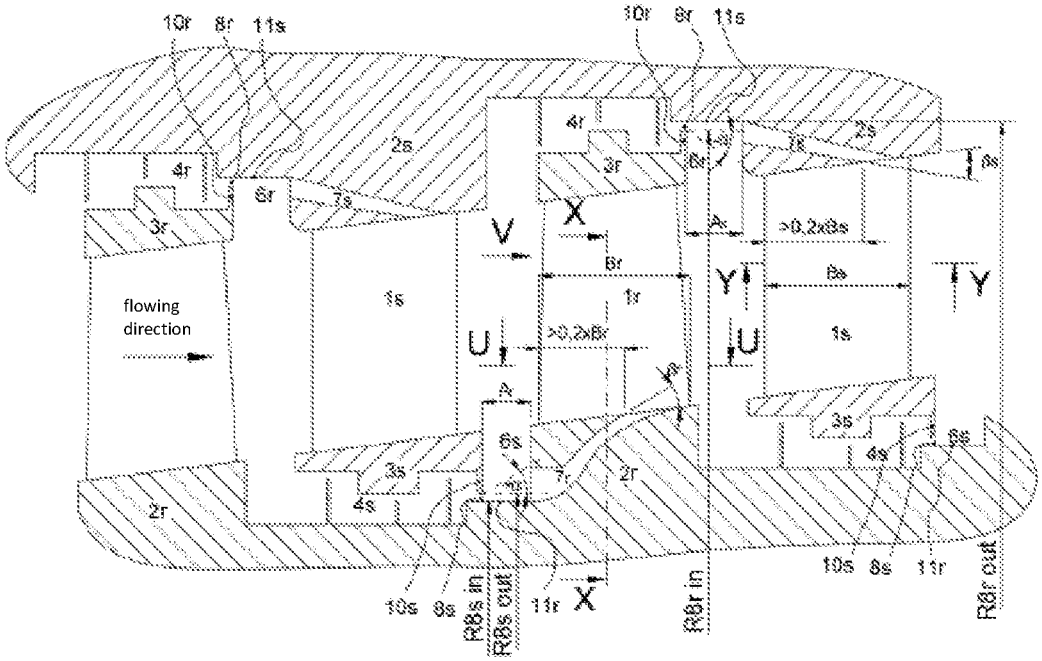
FIG. 12—longitudinal section of the flow path with axial stages of drum type with conical end wall surfaces at the hub and tip and non-contact seals of stator and rotor wheel of the staggered labyrinth type with additional fins in the outlet parts of the seals 10*s* and 10*r*. Shown are the passages in the fixing parts of the rotor and stator blades and the cylindrical surfaces 11*r* and 11*s* sealing against additional fins and guiding the working medium into the passage inlet.

According to FIG. 12, it is the same as the previous examples 1-3, but differs in the additional fins 10*s* and 10*r* in the outlet parts of the non-contact seals 4*s* and 4*r*. The additional fins improve sealing and, together with the opposing cylindrical surfaces 11*r* and 11*s*, better guide the flow into the passages 7*r* and 7*s*.

Embodiment 9

Figure 13:
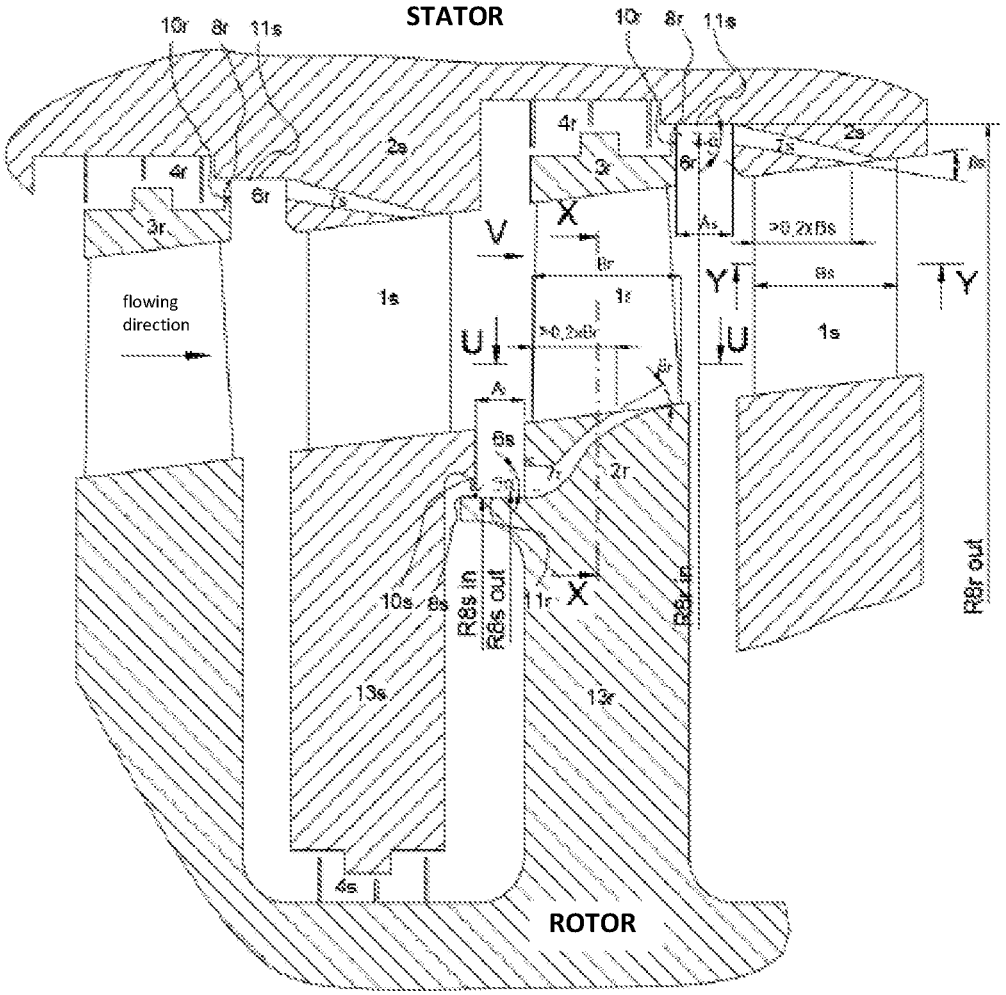
FIG. 13—longitudinal section of the flow path with axial stages of the wheel (disc) type with conical end wall surfaces at the hub and tip and non-contact seals of the stator and rotor wheel of the staggered labyrinth type with additional fins in the outlet parts of the seals 10*s* and 10*r*. Shown are the passages in the fixing parts of the rotor and stator blades and the cylindrical surfaces 11*r* and 11*s* sealing against additional fins and guiding the working medium into the passage inlet.

According to FIG. 13, the arrangement is for wheel (disc) type stages. Unlike the drum type stages (previous examples 1-8), the stator blade cascade in this embodiment is not sealed on its inner diameter with a shroud, but with a disc 13*s* which carries a non-contact seal 4*s* on its inner diameter. Discs 13*r* are formed on the rotor, to which the fixing parts 2*r* of the rotor blades 1*r* are attached. As the radial distance between the stator wheel seal 4*s* and the passage 7*r* in the fixing part 2*r* is too large, the kinetic energy of the secondary flow exiting 4*s* is lost along this path. Therefore, at least one additional fin 10*s* is formed on the outer diameter of the stator disc 13*s* which, together with the cylindrical surface 11*r* formed on the rotor disc 13*r* or on the fixing part 2*r*, re-accelerates the secondary flow, guiding it into the passage 7*r*. In this embodiment, this additional fin then represents the last fin of the labyrinth seal as defined in the claims.

Note on Marking:

The addition of the lower-case letter "r" or "s" to the reference characters and individual dimension markings indicates the respective element/dimension related to the rotor ("r") or stator ("s"), while in some cases there are markings without these "indices" in the description where it is not distinguished whether the respective element/dimension is related to the rotor or stator. This should make the analogy of the solution for the passages in the rotor wheel or stator wheel clearer.

The invention claimed is:

1. A turbine assembly of an axial-flow turbine, comprising a stator having a stator wheel and a rotor having a rotor wheel arranged in the direction of a working medium flow downstream, or turbine stage, wherein the stator wheel includes airfoils of blades arranged side by side around the circumference of the stator wheel to form a stator blade cascade, and at least one stator fixing part fixing the blades of the stator wheel to the stator and sealing the stator blade cascade at the outer circumference, wherein the stator blade cascade is sealed against the rotor at the inner circumference by at least one stator shroud or a stator disc with a non-contact seal of the stator wheel, the non-contact seal of the stator wheel having a last fin and axial gaps in front of and behind the non-contact seal of the stator wheel for connection to a primary flow path, and the rotor wheel includes airfoils of blades placed side by side around the circumference of the rotor wheel to form a rotor blade cascade, at least one rotor fixing part fixing the blades of the rotor wheel to the rotor or a rotor disc and which seals the rotor blade cascade on the inner circumference, wherein on the outer circumference the rotor blade cascade is sealed against the stator by at least one rotor shroud with a non-contact seal of the rotor wheel, the non-contact seal of the rotor wheel having a last fin and axial gaps in front of and behind the non-contact seal of the rotor wheel for connection to the primary flow path, wherein passages are formed in the at least one rotor fixing part of the rotor wheel at least between some adjacent blades of the rotor wheel for draining the working medium that has leaked through the non-contact seal of the stator wheel, from the axial gap behind the non-contact seal of the stator wheel into the primary flow path, wherein the inlet of the passages is located on the side of the fixing part facing the radial gap at the last fin of the non-contact seal of the stator wheel radially between a virtual circle with the centre on the axis of the turbine assembly and with a radius of $$R8s_{in} - 0.6 * Ar$$

and a virtual circle with the centre on the axis of the turbine assembly and a radius of $$R8s_{out} + 0.6 * Ar$$

where

R8*s*$_{in}$ is the inner radius of the radial gap at the last fin of the non-contact seal of the stator wheel, R8*s*$_{out}$ is the outer radius of the radial gap at the last fin of the non-contact seal of the stator wheel, and Ar is the axial distance between the last fin of the non-contact seal of the stator wheel and the side of the fixing part of the rotor wheel facing the radial gap at the last fin of the non-contact seal of the stator wheel in operation, the outlet of the passages exits into a primary flow path between the blades of the rotor wheel at an axial distance of at least ⅕*Br from the leading edge of the blades of the rotor wheel, where Br is the total axial width of the rotor blade cascade at the point of its connection to the fixing part of the rotor wheel.

2. The turbine assembly according to claim 1, wherein the passages are formed between each two adjacent blades of the rotor wheel.

3. The turbine assembly according to claim 1, wherein the inlet of the passages is located on the side of the fixing part of the rotor wheel facing the non-contact seal of the stator wheel radially at the level of the radial gap at the last fin of the non-contact seal of the stator wheel.

4. The turbine assembly according to claim 1, wherein the inlet of the passages extends in a circumferential direction across the entire width of the blade passage in a circumferential direction between adjacent blades of the rotor wheel.

5. The turbine assembly according to claim 1, wherein the radial height of the passages at the inlet exceeds or equals the radial size of the radial gap at the last fin of the non-contact seal of the stator wheel (R8*s*$_{out}$–R8*s*$_{in}$).

6. The turbine assembly according to claim 1, wherein the passages outlet cross-section has an area ranging from 20% to 120% of the area $Fs_{seal}$ of the radial gap at the last fin of the non-contact seal of the stator wheel.

7. The turbine assembly according to claim 1, wherein the outlet of the passages exits into the primary flow path between the blades of the rotor wheel at an angle βr, measured in the meridian plane from the blade passage end wall surface at the outlet of the passages, of less than 45°.

8. The turbine assembly according to claim 1, wherein at least another additional fin of the non-contact seal of the stator wheel is formed on the at least one stator shroud of the stator wheel or on the stator disc, and at least one cylindrical surface is formed on the at least one rotor fixing part of the rotor wheel or directly on the rotor or on the rotor disc, forming together with this additional fin the radial gap at the last fin of the non-contact seal of the stator wheel and connecting radially the inner side of this last radial gap of the non-contact seal of the stator wheel with radially inner side of the inlet of the passages.

9. A turbine assembly of an axial-flow turbine, comprising a rotor having a rotor wheel and a stator having a stator wheel arranged in the direction of a working medium flow downstream, wherein the rotor wheel includes airfoils of blades arranged side by side around the circumference of the rotor wheel to form a rotor blade cascade, and at least one rotor fixing part fixing the blades of the rotor wheel to the rotor or a rotor disc and sealing the rotor blade cascade at the inner circumference, wherein the rotor blade cascade is sealed against the stator at the outer circumference by at least one rotor shroud with a non-contact seal of the rotor wheel, the non-contact seal of the rotor wheel having a last fin and axial gaps in front of and behind the non-contact seal of the rotor wheel for connection to a primary flow path, and the stator wheel includes airfoils of blades placed side by side around the circumference of the stator wheel to form a stator blade cascade, at least one stator fixing part fixing the blades of the stator wheel to the stator and which seals the stator blade cascade on the outer circumference, wherein on the inner circumference the stator blade cascade is sealed against the rotor by at least one stator shroud or a stator disc with a non-contact seal of the stator wheel, the non-contact seal of the stator wheel having a last fin and axial gaps in front of and behind the non-contact seal of the stator wheel for connection to the primary flow path, wherein at least between some adjacent blades of the stator wheel, passages are formed in the at least one fixing part of the stator wheel for draining the working medium that has leaked through the non-contact seal of the rotor wheel from the axial gap behind the non-contact seal of the rotor wheel into the primary flow path, wherein the inlet of the passages is located on the side of the fixing part facing radial gap at the last fin of the non-contact seal of the rotor wheel radially between a virtual circle with the centre on the axis of the turbine assembly and with a radius of $$R8r_{in} - 0.6 * As$$

and a virtual circle with the centre on the axis of the turbine assembly and a radius of $$R8r_{out} + 0.6 * As$$

where $R8r_{in}$ is the inner radius of the radial gap at the last fin of the non-contact seal of the rotor wheel, $R8r_{out}$ is the outer radius of the radial gap at the last fin of the non-contact seal of the rotor wheel, and As is the axial distance between the last fin of the non-contact seal of the rotor wheel and the side of the fixing part of the stator wheel facing the radial gap at the last fin of the non-contact seal of the rotor wheel in operation, the outlet of the passages exits into the primary flow path between the blades of the stator wheel at an axial distance of at least ⅕*Bs from the leading edge of the blades of the stator wheel, where Bs is the total axial width of the stator blade cascade at the point of its connection to the fixing part of the stator wheel.

10. The turbine assembly according to claim 9, wherein passages are formed between each two adjacent blades of the stator wheel.

11. The turbine assembly according to claim 9, wherein the inlet of the passages is located on the side of the fixing part of the stator wheel facing the non-contact seal of the rotor wheel radially at the level of the radial gap at the last fin of the non-contact seal of the rotor wheel.

12. The turbine assembly according to claim 9, wherein the inlet of the passages extends in a circumferential direction across the entire width of the blade passage in a circumferential direction between adjacent blades of the stator wheel.

13. The turbine assembly according to claim 9, wherein the radial height of the passages at the inlet exceeds or equals the radial size of the radial gap (8*r*) at the last fin of the non-contact seal of the rotor wheel ($R8r_{out}$–$R8r_{in}$).

14. The turbine assembly according to claim 9, wherein the outlet of the passages extends in a circumferential direction across the entire width of the blade passage in a circumferential direction between adjacent blades of the stator wheel.

15. The turbine assembly according to claim 14, wherein the radial height of the passages at the outlet to the primary blade passage is 0.25 to 1.1 times its radial height at the inlet.

16. The turbine assembly according to claim 9, wherein the outlet of the passages exits into the primary flow path between the blades of the stator wheel at an axial distance of at least ½*Bs from the leading edge of the blades of the stator wheel, where Bs is the total axial width of the stator blade cascade at the point of its connection to the fixing part of the stator wheel.

17. The turbine assembly according to claim 9, wherein the outlet cross-section of the passages has an area ranging from 20% to 120%, of the area $Fr_{seal}$ of the radial gap at the last fin of the non-contact seal of the rotor wheel.

18. The turbine assembly according to claim 9, wherein the outlet of the passages exits into the primary flow path between the blades of the stator wheel at an angle βs, measured in the meridian plane from the blade passage end wall surface at the outlet of the passages, of less than 45°.

19. The turbine assembly according to claim 9, wherein at least another additional fin of the non-contact seal of the rotor wheel is formed on the at least one rotor shroud of the rotor wheel, and at least one cylindrical surface is formed on the at least one stator fixing part of the stator wheel or directly on the stator, forming together with this additional fin the radial gap at the last fin of the non-contact seal of the rotor wheel and connecting radially the outer side of this last radial gap of the non-contact seal of the rotor wheel with radially outer side of the inlet of the passages.

20. An axial-flow turbine, comprising at least one turbine assembly according to claim 1.

21. An axial-flow turbine, comprising at least one turbine assembly according to claim 9.

* * * * *